US005971065A

United States Patent [19]

Bertilson et al.

[11] Patent Number: 5,971,065

[45] Date of Patent: Oct. 26, 1999

[54] PLATE HEAT EXCHANGER

[75] Inventors: Klas Bertilson, Eslöv, Sweden; Alvaro Zorzin, Romans d'Isonzo, Italy

[73] Assignee: Alfa Laval AB, Lund, Sweden

[21] Appl. No.: 09/051,945

[22] PCT Filed: Oct. 16, 1996

[86] PCT No.: PCT/SE96/01309

§ 371 Date: Apr. 23, 1998

§ 102(e) Date: Apr. 23, 1998

[87] PCT Pub. No.: WO97/15797

PCT Pub. Date: May 1, 1997

[30] Foreign Application Priority Data

Oct. 24, 1995 [IT] Italy ..... MI95A2192

[51] Int. Cl.[6] ..... F28F 3/00

[52] U.S. Cl. ..... 165/166; 165/167; 165/153

[58] Field of Search ..... 165/152, 153, 165/166, 167

[56] References Cited

U.S. PATENT DOCUMENTS

| | | | |
|---|---|---|---|
| 3,760,873 | 9/1973 | Wright | 165/166 |
| 4,270,602 | 6/1981 | Foster | 165/167 |
| 4,470,455 | 9/1984 | Sacca | 165/167 |
| 4,987,955 | 1/1991 | Bergqvist et al. | 165/166 |
| 5,203,406 | 4/1993 | Blomgren et al. | 165/167 |
| 5,435,383 | 7/1995 | Rajagopal | 165/153 |
| 5,509,471 | 4/1996 | Hallgren | 165/167 |

FOREIGN PATENT DOCUMENTS

| | | |
|---|---|---|
| 469 669 | 8/1993 | Sweden . |
| WO 94/14021 | 6/1994 | WIPO . |
| WO 95/00810 | 1/1995 | WIPO . |

*Primary Examiner*—Ira S. Lazarus
*Assistant Examiner*—Terrell McKinnon
*Attorney, Agent, or Firm*—Fish & Richardson P.C.

[57] ABSTRACT

A plate heat exchanger, which comprises a stack of heat transfer plates (2A; 2B) and is intended for evaporation of a liquid, e.g. refrigerant, has an inlet channel (17A; 17B) for said liquid extending through the plate stack and a separate distribution channel (18A; 18B) also extending through the plate stack. Through first passages (25A; 25B) formed by the heat transfer plates (2A; 2B) the inlet channel (17A; 17B) communicates with the distribution channel (18A; 18B), and through second passages (26A; 26B) also formed by the heat transfer plates (2A; 2B) the distribution channel (18A; 18B) communicates with evaporation flow paths (13A; 13B) defined in alternate plate interspaces between the heat transfer plates (2A; 2B).

9 Claims, 3 Drawing Sheets

PLATE HEAT EXCHANGER

FIELD OF THE INVENTION

The present invention relates to a plate heat exchanger for evaporation of a first fluid, e.g. a refrigerant, by means of a second fluid, comprising a plate stack of heat transfer plates, which are provided with inlet ports forming an inlet channel through said plate stack for said first fluid, and sealing means arranged between the heat transfer plates to delimit therebetween alternating first flow paths and second flow paths for through flow of the first and second fluids, respectively, said inlet channel being in communication with said first flow paths but closed by said sealing means from communication with said second flow paths.

BACKGROUND OF THE INVENTION

Plate heat exchangers of this kind are frequently used as evaporators for evaporation of refrigerants circulated in refrigeration systems. Such a refrigeration system normally includes a compressor, a condenser, an expansion valve and an evaporator, all coupled in series. A plate heat exchanger used as an evaporator in a system of this kind often has heat transfer plates which are welded or brazed together, but also gaskets may be used as sealing means between the heat transfer plates. Normally, the passages present between the inlet channel and the evaporation flow paths between the heat transfer plates have the same size.

A problem recognized in connection with a refrigeration system of the above said kind, using a plate heat exchanger as an evaporator, is that refrigerant entering the said inlet channel of the plate heat exchanger is not evenly distributed to the various evaporation flow paths between the heat transfer plates. One reason for this may be that the refrigerant, which when entering the inlet channel is already partly evaporated after having passed through the expansion valve, does not remain in the form of a homogeneous liquid/vapour mixture along the whole of the inlet channel but tends to partly separate into streams of liquid and vapour, respectively.

Uneven distribution of refrigerant to the different evaporation flow paths in the plate heat exchanger leads to ineffective use of certain parts of the plate heat exchanger, in which parts the refrigerant is also unnecessarily overheated.

To avoid the problem of uneven distribution of the refrigerant in a plate heat exchanger of the above mentioned kind it has been suggested in the Swedish Patent Application No. 8702608-4, that a restriction means should be arranged in each passage between the inlet channel of the plate heat exchanger and each plate interspace forming an evaporation flow path, as defined above, for the refrigerant. The restriction means could be a ring or a washer provided with a hole and being arranged between adjacent pairs of the heat transfer plates. Alternatively, the restriction means could be a pipe having several holes and being arranged in the inlet channel of the plate heat exchanger. As a further alternative the restriction means could be formed integral with the heat transfer plates. Thus, plate edge portions delimiting the inlet ports of two adjacent heat transfer plates could be folded to abutment against each other, edge to edge, except in small areas forming inlet openings for the refrigerant to the flow paths formed between the adjacent plates.

Plate heat exchangers having restriction means of the kind just described are difficult to manufacture. Use of separate rings or washers is far too expensive and it is difficult to locate the rings or the washers in correct positions when a plate heat exchanger is to be assembled. A restriction means in the form of a pipe must be adapted as to its length to the number of heat transfer plates included in the plate heat exchanger and must also be correctly positioned relative to the inlet passages leading into the flow paths between the heat transfer plates. Folding of port edge portions of the plates has proved unpracticable, depending on the fact that the heat transfer plates are mostly produced from very thin sheet metal, and it is difficult to obtain well-defined inlet openings leading into the plate interspaces in the way suggested in said Swedish patent application.

DE 4422178 shows a distribution device for a two-phase refrigerant flow in a plate heat exchanger, including a hollow body with porous walls arranged in the inlet channel of the plate heat exchanger. The porous body has a central channel receiving the two-phase refrigerant coming from an expansion valve at the inlet of the plate heat exchanger and conducting it through the porous body along said inlet channel. Preferably, it is said, the porous body is tapered from the inlet end of the inlet channel and is surrounded by a sleeve having throttle openings opposite to the respective passages leading to the evaporation flow paths between the heat transfer plates. A disadvantage with this distribution device is that it is expensive and must be adapted to the length of the inlet channel.

WO 94/14021 also shows a plate heat exchanger to be used as an evaporator in a refrigeration system. A distributor in the form of a perforated tube is arranged in the refrigerant inlet port channel of the plate heat exchanger. The distributor may include flow regulating means. Also this refrigerant distribution device is expensive and disadvantageous in that it must be adapted to the length of the inlet port channel of the plate heat exchanger.

SUMMARY OF THE INVENTION

The object of the present invention is to avoid the above mentioned disadvantages of previously known plate heat exchangers and to provide a plate heat exchanger, which is easy and cheap to manufacture and in which the heat transfer plates are formed such that an even distribution of a refrigerant or other liquid to be evaporated can be obtained to the various evaporation flow paths between the heat transfer plates.

This object can be achieved according to the present invention by a plate heat exchanger of the initially described kind, which is primarily characterized in that the heat transfer plates are provided with additional ports forming a distribution channel through the plate stack and that the heat transfer plates form first passages, which are distributed along said inlet channel and interconnect the latter with said distribution channel, and second passages connecting the distribution channel with said first flow paths between the heat transfer plates.

By the present invention no extra components are needed for accomplishment of restriction of the refrigerant or other liquid flow into the separate flow paths forming evaporation spaces between the heat transfer plates.

Such restriction is accomplished by pre-forming of the heat transfer plates before assembling thereof. This means that any number of heat transfer plates pre-formed in this way can be assembled to a plate heat exchanger, and no particular effort has to be made to adapt the restriction means with regard to the number of heat transfer plates thus used.

In a plate heat exchanger according to the invention an incoming flow of refrigerant, or other liquid to be evaporated, is subjected to a first pressure drop and a partial evaporation when passing through said first passages formed between said inlet channel and said distribution channel. It then undergoes a pressure equalization in the distribution channel before entering, through said second passages, the evaporation flow paths formed between the heat transfer plates. This results in a very even distribution of the refrigerant to the various flow paths between the heat transfer plates and, thereby, to a very effective utilization of the plate heat exchanger. In the case of a refrigerant being partly evaporated already when entering the inlet channel, the present invention has the effect of improving homogeneity of the refrigerant liquid/vapour mixture before it enters the evaporation flow paths formed between the heat transfer plates.

As indicated above, a plate heat exchanger according to the invention can be used not only for evaporation of refrigerants but also for evaporation of other liquids. This means that use of an expansion valve of the kind often used in a refrigeration system is not always necessary. Instead, the above said first passages forming a communication between said inlet channel and said distribution channel of the plate heat exchanger according to the invention may form means for a first partial evaporation of an incoming liquid, which is then further evaporated in the real evaporation flow paths between the heat transfer plates. Possibly, the conventional expansion valve of a refrigeration system could be dispensed with when a plate heat exchanger according to the present invention is used in such a system.

BRIEF DESCRIPTION OF THE DRAWINGS

The invention is described in the following with reference to the accompanying drawings, in which.

DETAILED DESCRIPTION

Figure 1:
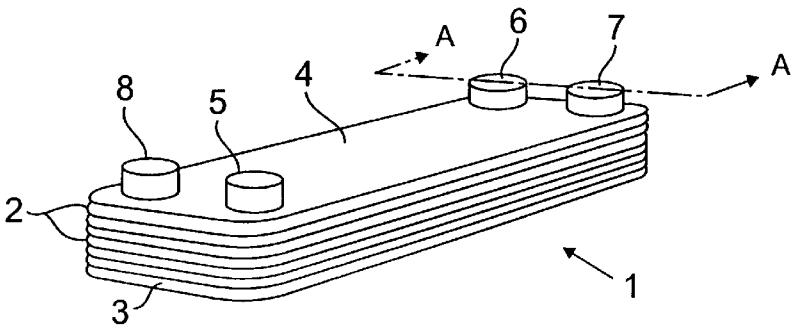
FIG. 1 (PRIOR ART)
FIG. 1 shows a perspective view of a plate heat exchanger.

FIG. 1 shows a plate heat exchanger 1 comprising a stack of heat transfer plates 2 and two outer cover plates 3 and 4 arranged at the bottom and the top, respectively, of said stack. The plate heat exchanger 1 has first and second inlets 5 and 6, and first and second outlets 7 and 8, for two heat exchange fluids.

Figure 2:
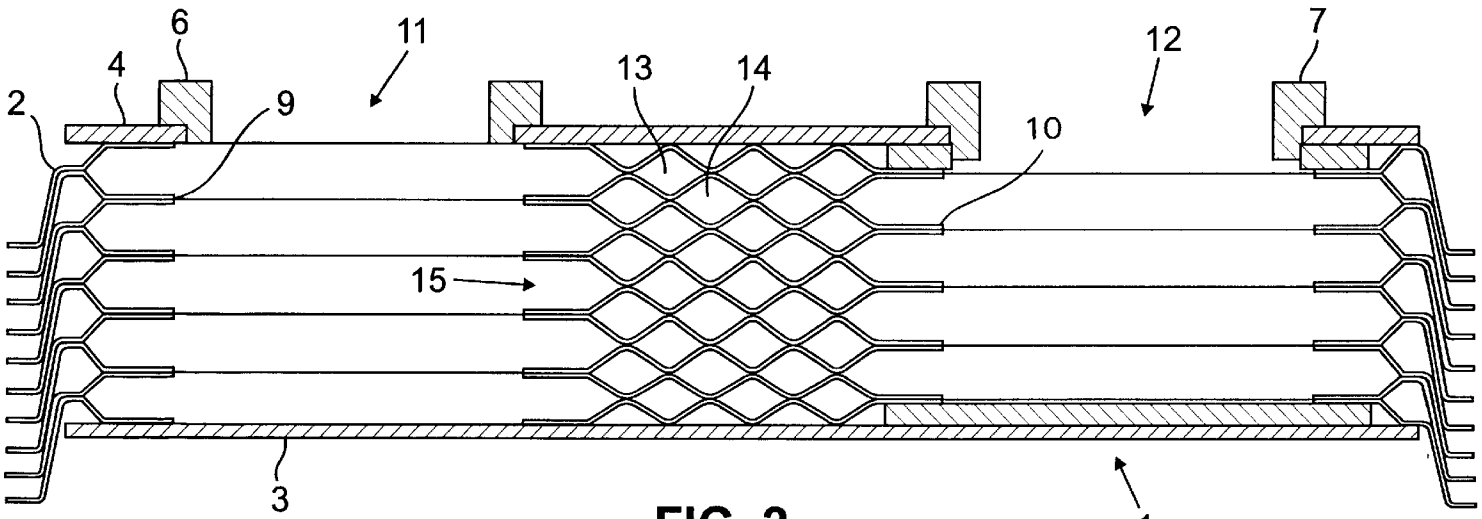
FIG. 2 (PRIOR ART)
FIG. 2 shows a cross-section through a conventional plate heat exchanger as seen a long the line A—A in FIG. 1.

The plate heat exchanger, shown in FIG. 2, comprises ten heat transfer plates 2, which are arranged on top of each other between the upper cover plate 4 and the lower cover plate 3. The number of heat transfer plates 2 of the heat exchanger may of course vary with respect to the desired heat transfer capacity of the plate heat exchanger.

The heat transfer plates 2 are provided with ports 9 and 10. The respective ports 9 and 10 are aligned with each other, such that the ports 9 form an inlet channel 11 and the ports 10 form an outlet channel 12 through the plate stack. The inlet channel 11 is at one end connected to the inlet pipe 6 for a first heat exchange fluid and the outlet channel 12 is connected to the outlet pipe 7 for a second heat exchange fluid.

The plate heat exchanger 1 in a conventional manner is provided with sealing means between the heat transfer plates 2, which together with the respective heat transfer plates form in every second plate interspace a first flow path 13 for said first heat exchange fluid and in the remaining plate interspaces second flow paths 14 for said second heat exchange fluid.

The heat transfer plates 2 are provided with a corrugation pattern of parallel ridges extending such that the ridges of adjacent heat transfer plates 2 cross and abut against each other in the plate interspaces. Each first flow path 13 communicates with the inlet channel 11 through at least one inlet opening 15 formed between the ports 9 of two adjacent heat transfer plates 2. Each second flow path 14 communicates in the same way with the outlet channel 12.

The described plate heat exchanger comprises rectangular heat transfer plates 2, but of course heat transfer plates having a different shape, e.g. round heat transfer plates, can be used.

The plates of the plate heat exchanger can either be permanently joined by brazing, gluing or welding, or be provided with gaskets permitting disassembling of the plate heat exchanger.

Figure 3:
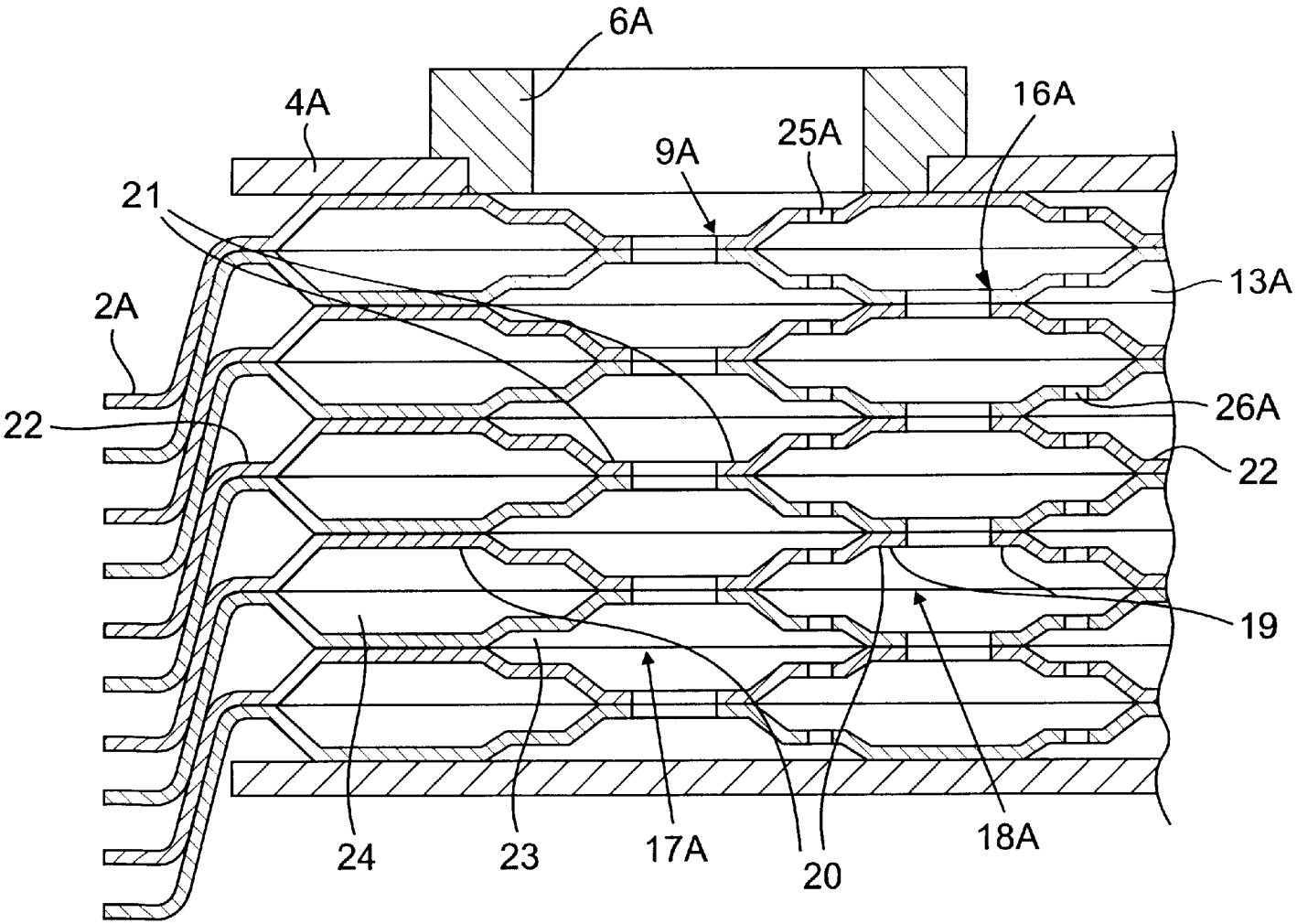
FIG. 3 shows a cross-section through part of a plate heat exchanger according to a first embodiment of the invention as seen along the line A—A in FIG. 1.

FIG. 3 shows part of a plate heat exchanger designed according to a first embodiment of the present invention. Each one of the heat transfer plates 2A is provided with a first port 9A and, at a small distance therefrom, a second port 16A. All first ports 9A are aligned and form an inlet channel 17A extending through the stack of heat transfer plates 2A, and all second ports 16A are also aligned and form a distribution channel 18A extending in parallel with the inlet channel 17A through the stack of heat transfer plates.

In the area of the ports 9A and 16A the heat transfer plates are formed by pressing in a way such that every two adjacent heat transfer plates, which delimit between themselves a flow path 13A intended for through flow of said first fluid, abut against each other both in a first area 19, extending closely around the ports 16A, and in a second area 20 extending around the ports 9A at some distance from the plate edge portions forming these ports 9A. Each one of said two adjacent heat transfer plates 2A abuts against another adjacent heat transfer plate, with which it delimits a flow path (not shown in FIG. 3) intended for through flow of said second fluid, both in a third area 21 extending closely around the ports 9A and in a fourth area 22 extending around the whole area of the respective heat transfer plates, in which the ports 9A and 16A are formed. The heat transfer plates are permanently joined together, e.g. by brazing, in all of said areas 19–22.

In this way there are formed in alternating plate interspaces, in the areas of the ports 9A and 16A, circular chambers 23 communicating with the above said inlet channel 17A and annular chambers 24 communicating with the above said distribution channel 18A.

For communication between the inlet channel 17A and the distribution channel 18A there are first passages in the form of through holes 25A in the heat transfer plates 2A. Preferably, at least one hole 25A connects each one of said chambers 23 with one of said chambers 24. Furthermore, for communication between the distribution channel 18A and each one of the flow paths 13A for through flow of the liquid to be evaporated there are second passages also in the form of through holes 26A in the heat transfer plates 2A. Preferably, at least one hole 26A connects one of said chambers 24 with one of said flow paths 13A.

The number and size of the holes 25A and 26A can easily be adapted to any desired restriction of the fluid flow between the chambers 17A and 18A and into the flow paths 13A. Holes 25A and 26A may be made in all or just every second one of the heat transfer plates 2A. If there are more than one hole communicating with one or both of said chambers 23 and 24, such holes may be distributed around the inlet channel 17A or the distribution channel 18A, respectively. The spacing between the holes 25A and 26A, both along and around the inlet channel 17A and the distribution channel 18A, respectively, can be varied according to need.

By the present invention it is possible optionally to choose an appropriate size for the holes 25A and 26A and, thereby, well-defined inlet openings for restriction of the incoming refrigerant can be formed. Essential for the invention is that the flow of refrigerant or other liquid to be evaporated undergoes a first pressure reduction when passing through the holes 25A between the inlet channel 17A and the distribution channel 18A and a second pressure reduction when passing through the holes 26A between the distribution channel 18A and the evaporation flow paths 13A between adjacent heat transfer plates.

Thus, in a plate heat exchanger according to the present invention the restriction means for the flow of refrigerant or other liquid into the evaporation flow paths is integrated in the heat transfer plates, and thereby the cost for production and assembly of the plate heat exchanger is low.

Figure 4:
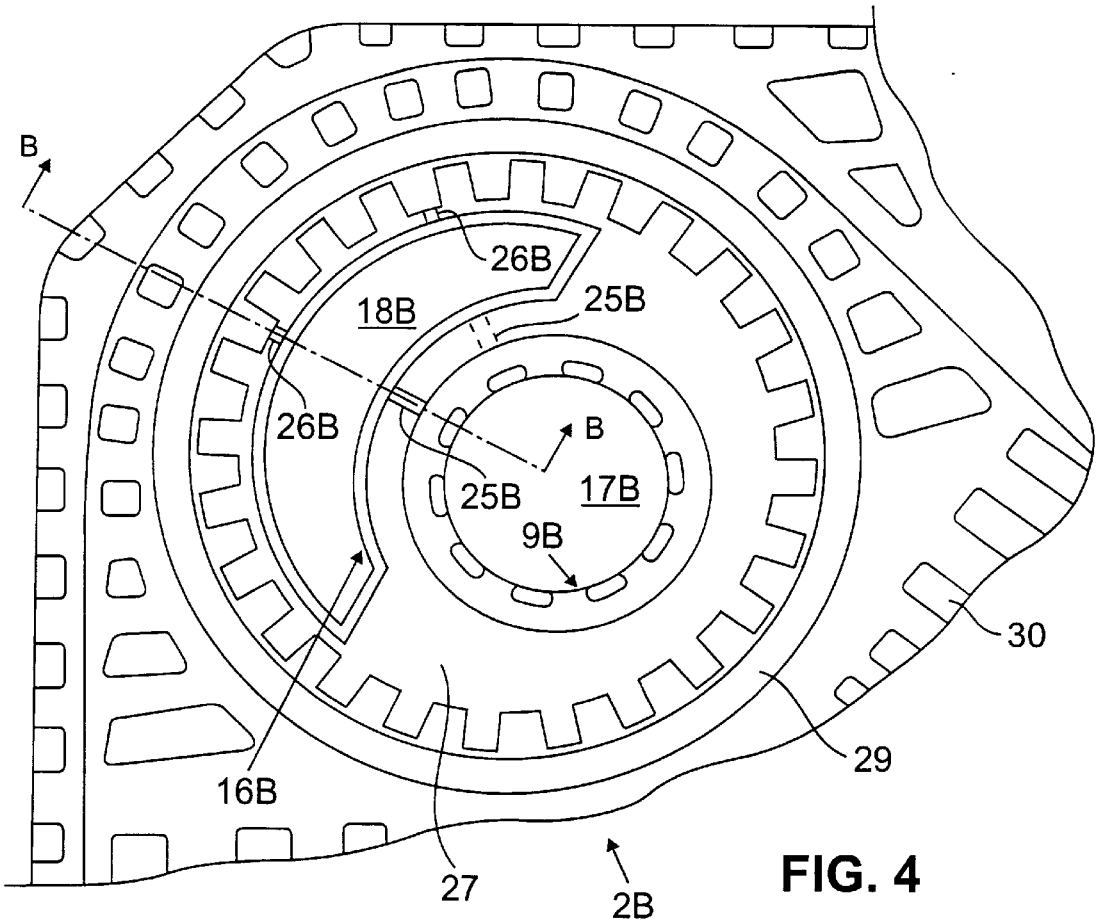
FIG. 4 shows part of a heat transfer plate to be included in a plate heat exchanger according to an additional embodiment of the invention.
Figure 5:
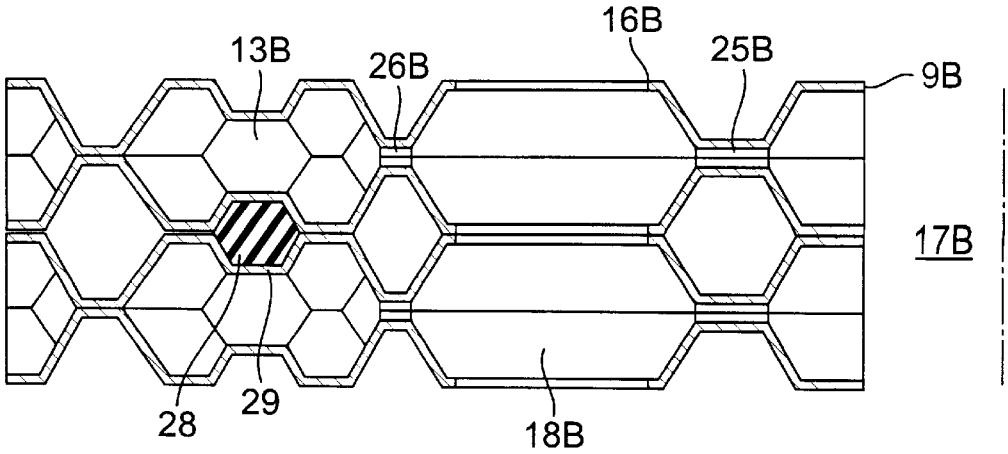
FIG. 5 shows a cross-section through a stack of FIG. 4 plates, as seen along the line B—B in FIG. 4.

FIGS. 4 and 5 illustrate a further embodiment of the present invention. FIG. 4 shows a corner portion of a heat transfer plate 2B and FIG. 5 shows a cross-section through a stack of four such plates as seen along the line B—B in FIG. 4.

Each heat transfer plate 2B has in its corner portion a circular inlet port 9B and crescent formed additional port 16B. As shown in FIG. 5, the various inlet ports 9B of the plates are aligned and form an inlet channel 17B through the plate stack, and the additional ports 16B form a distribution channel 18B.

The heat transfer plates 2B are formed by pressing of their respective corner portions in a way such that they abut against each other as follows.

Every two heat transfer plates, which delimit between themselves an evaporation flow path 13B for a fluid to be evaporated, abut against each other in an extended area 27, shown in FIG. 4. This area 27 surrounds each one of the respective ports 9B and 16B of the two plates; and the plates are also welded together in this area around the respective ports 9B and 16B.

However, in small parts of said area 27 at least one of the two plates, on its side facing the other plate, is provided with narrow grooves 25B and 26B, leaving the two plates without abutment or inter-connection at these small parts of the area 27. This means, as can be seen from FIG. 5, that said groove 25B form a first passage connecting the inlet channel 17B with the distribution channel 18B, and that said groove 26B form a second passage connecting the distribution channel 18B with an evaporation flow path 13B formed between the two adjacent heat transfer plates 2B.

While the two uppermost heat transfer plates 2B shown in FIG. 5 form a first pair of plates connected with each other in the way just described, the two other plates shown in FIG. 5 form an adjacent second pair of plates connected with each other in the same way. These two pairs of plates are superimposed onto each other, and both the inlet channel 17B and the distribution channel 18B are sealed off from communication with the main part of the plate interspace formed between these two plate pairs by means of an annular gasket 28. The gasket 28 is housed in opposing gasket grooves 24, which are pressed in the two plates of the plate pairs facing each other (see FIG. 5) and which extend all around the areas of the respective plates, in which the inlet ports 9B and the additional ports 16B are formed (see FIG. 4).

Differing, thus, from the FIG. 3 embodiment, according to which the respective first and second passages have the form of through holes 25A, 26A in the heat transfer plates, the embodiment according to FIGS. 4 and 5 has corresponding passages formed by depressions or grooves 25B, 26B pressed in the heat transfer plates. Each passage 25B, 26B may be formed by a groove in only one of the relevant plates or be formed by two opposing grooves in both plates, as shown in FIG. 5. In FIG. 4 it has been indicated by dotted lines that more than one passage 25B and more than one passage 26B may be formed.

Of course, any desired number, size and location of the passages can be chosen according to need and be easily accomplished by pre-forming of the heat transfer plates before assembling thereof.

Obviously, the pairs of plates having only gaskets as sealing means between themselves, as shown in FIG. 5, can be separated for exchange of the gaskets, if necessary. It should be noticed with regard to FIG. 5 that the evaporation flow path 13B defined between the two plates of each said plate pairs extends all around the area 27 of the respective plates, in which these plates abut and seal against each other. The main part of the evaporation flow path 13B is formed between the main heat transfer portions of the plates, one part of which is shown at 30 in FIG. 4. Thus, liquid to be evaporated will have to flow from the inlet channel 17B through the passage 25B, the distribution chamber 18B and the passage 26B before entering the evaporation flow path 13B in an area thereof situated between the distribution channel 18B and the upper left corner portion of the plate shown in FIG. 5. Thence, it will flow on both sides of the distribution channel 18B and the inlet channel 17B, respectively, to said main part of the evaporation flow path 13B.

Normally, when used in a refrigeration system, the plate heat exchanger is arranged with its plates extending vertically and having its inlet channel 17B for the liquid to be evaporated placed at the lower part of the plate heat exchanger. However, the plates may alternatively be used in an orientation as indicated in FIG. 5.

If desired, without departure from the inventive idea, the distribution channel (18A or 18B) may be divided into a few separate distribution channel parts, each one extending past several heat transfer plates and communicating through passages (26A or 26B) with several plate interspaces or flow paths (13A or 13B) between the heat transfer plates.

What is claimed is:

1. A plate heat exchanger for evaporation of a first fluid, e.g. a refrigerant, by means of a second fluid, comprising a plate stack of heat transfer plates (2A;2B), which are provided with inlet ports (9A;9B) forming an inlet channel (17A;17B) through said plate stack for said first fluid, and sealing means arranged between said heat transfer plates to delimit therebetween alternating first flow paths (13A;13B) and second flow paths for through flow of the first and second fluids, respectively, said inlet channel (17A;17B) being in communication with said first flow paths (13A;13B) but being closed by said sealing means from communication with said second flow paths, wherein the heat transfer plates (2A;2B) are provided with additional ports (16A;16B) forming a distribution channel (18A;18B) through the plate stack and the heat transfer plates (2A;2B) form first passages (25A:25B), which are distributed along said inlet channel (17A;17B) and interconnect the latter with said distribution channel (18A;18B), and second passages (26A;26B) connecting the distribution channel (18A;18B) with said first flow paths (13A;13B) between the heat transfer plates.

2. A plate heat exchanger according to claim 1, in which said first and second passages (25A,25B;26A,26B) are dimensioned so that they form throttled communications between the inlet channel (17A;17B) and the distribution channel (18A;18B) and between the distribution channel (18A;18B) and said first flow paths (13A;13B), respectively.

3. A plate heat exchanger according to claim 1, in which said first or second passages are formed by through holes (25A;26A) in the respective heat transfer plates.

4. A plate heat exchanger according to claim 1, in which said first or second passages are formed by and between adjacent heat transfer plates (2B) abutting against each other, a depression (25B;26B) being formed in at least one of such adjacent heat transfer plates.

5. A plate heat exchanger according to claim 1, in which the size of said first passages (25A;25B) differs along said inlet channel (17A;17B).

6. A plate heat exchanger according to claim 1, in which said first passages (25A;25B) are distributed around the circumference of the inlet channel (17A;17B).

7. A plate heat exchanger according to claim 1, in which there are more than one of said second passages (26A;26B) provided for communication between the distribution channel (18A;18B) and each one of said first flow paths (13A, 13B) and distributed around the circumference of said distribution channel (18A;18B).

8. A plate heat exchanger according to claim 1, in which the number of said first passages (25A;25B) differs per unit of length along said inlet channel (17A;17B).

9. A plate heat exchanger according to claim 1, in which adjacent heat transfer plates (2A) in pairs seal against each other both around their said inlet ports (9A) and around their said additional ports (16A), adjacent heat transfer plates (2A) of adjacent said pairs seal against each other all around their respective said inlet ports (9A) at two spaced areas (21,22), leaving between these areas an interspace (24) between the plates which also extends around said inlet channel (17A), and said distribution channel (18A) extends through each said space (24) extending around said inlet channel (17A).

* * * * *